United States Patent [19]

Ozbey et al.

[11] 4,089,520

[45] May 16, 1978

[54] PLATFORM EXERCISE APPARATUS WITH SPRING TENSIONED ARM AND LEG EXERCISE ASSEMBLIES

[76] Inventors: Ahmet Ozbey; Amber L. Ozbey; Suzan N. Ozbey, all of 8221 Clay Dr., Oxon Hill, Md. 20022

[21] Appl. No.: 721,423

[22] Filed: Sep. 8, 1976

[51] Int. Cl.[2] ..... A63B 21/04

[52] U.S. Cl. ..... 272/136; 272/141; 272/142; 272/143; 272/144

[58] Field of Search ..... 272/142, 135, 136, 134, 272/116, 144, 132, 72, 76; 128/57, 24 R

[56] References Cited

U.S. PATENT DOCUMENTS

| | | | |
|---|---|---|---|
| 1,518,361 | 12/1924 | Ruden | 272/134 |
| 1,990,124 | 2/1935 | Kabisius | 272/71 |
| 3,731,921 | 5/1973 | Andrews | 272/71 |
| 3,976,058 | 8/1976 | Tidwell | 272/134 |

FOREIGN PATENT DOCUMENTS

| | | | |
|---|---|---|---|
| 515,747 | 1/1931 | Germany | 272/71 |

*Primary Examiner*—William R. Browne

*Attorney, Agent, or Firm*—Sixbey, Bradford & Leedom

[57] ABSTRACT

The exercise apparatus includes a platform having arm exercise members extending laterally from opposite sides thereof. These arm exercise members are mounted to pivot vertically and horizontally and spring means are provided to oppose this pivotal movement. Also a leg and abdominal exercise member is mounted on the platform for universal pivotal movement relative to the platform. This leg and abdominal exercise member provides exercises against spring tension along the longitudinal axis of the member and also outwardly in a lateral direction from the member.

7 Claims, 3 Drawing Figures

PLATFORM EXERCISE APPARATUS WITH SPRING TENSIONED ARM AND LEG EXERCISE ASSEMBLIES

BACKGROUND OF THE INVENTION

This invention relates to an exercising apparatus for exercising various parts of the body which combines with the exercising means, a mat on which the exercises are carried out.

Prior art exercise devices generally provide separate apparatus for exercising the arms or the legs and/or abdomen but not all at once. Also prior art apparatus do not provide a mat upon which the user can lie down in comfort which is an integral part of the apparatus.

An object of this invention is therefore to provide an exercise apparatus where one can do combined exercises for different parts of the body simultaneously if desired.

A further object is to provide an exercise apparatus having a mat as an integral part thereof.

SUMMARY OF THE INVENTION

An exercise apparatus comprises a platform for supporting the body of the user while lying down and mounted to said platform at two opposing sides thereof, spring tension controlled hinged arm exercise members and further mounted thereto and extending upwardly therefrom, a pivotable leg and abdominal exercise member having spring tension means, and foot support means.

DETAILED DESCRIPTION OF THE PREFERRED EMBODIMENT

Figure 1:
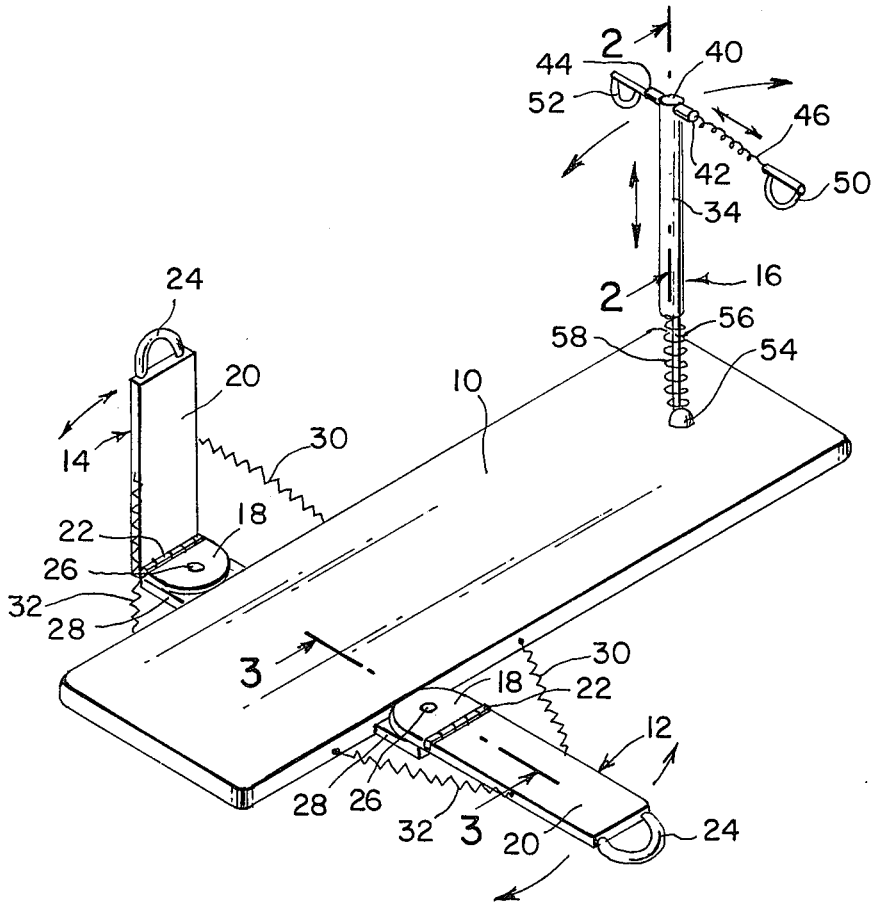
FIG. 1 is a perspective elevational view of an embodiment of the invention.
Figure 2:
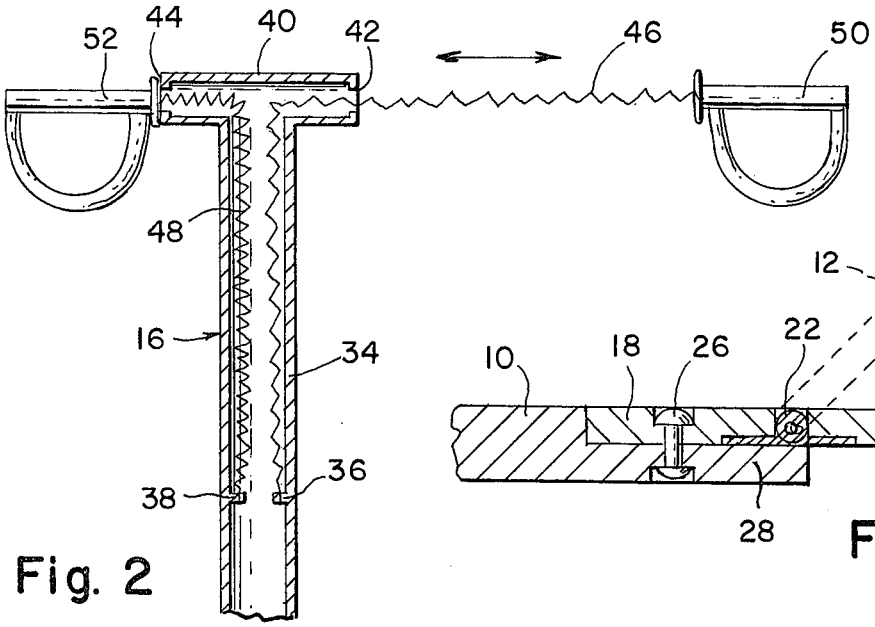
FIG. 2 is a cross-sectional view through sections 2—2 of part of the apparatus shown in FIG. 1.
Figure 3:
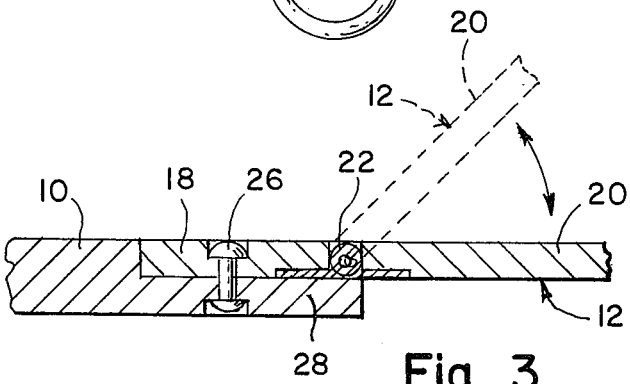
FIG. 3 is a cross-sectional view through section 3—3 of part of the apparatus of FIG. 1.

Referring to FIG. 1 there is shown a rectangular platform 10 which may be made from plywood or other rigid material and which is preferably padded to as to form a comfortable mat. Alternatively the platform 10 may be made of a metal or wood frame having a foam rubber or other type of mat material formed around the frame and covering the central area defined by the frame so as to provide a soft comfortable matter upon which the user can lie down while exercising.

Connected with the platform 10 are arm exerciser members 12 and 14 and leg and abdominal exerciser member 16. These members are pivotably connected to the platform 10 in any desired manner. As shown herein, each arm exerciser member 12 and 14 consists of a short flat arcuate end piece 18 and an elongated rectangular piece 20 connected to the end piece 18 by means of a hinge 22. The end of the rectangular piece 20 opposite the hinge 22 is provided with hand grip means 24 which may simply be a loop in the shape of a horseshoe formed from a plastic, metal or fabric type material. The arm exerciser members 12 and 14 are connected to the platform 10 at opposite sides of the rectangular platform 10 approximately one fourth of the distance from an end of the platform 10 by means of a pivot pin 26 which extends through a countersunk hole in the arcuate end piece 18 of the exerciser member and through a countersunk hole in an extension 28 of the platform 10. In this manner the arm members 12 and 14 can be pivoted about the pivot pin 26 in the horizontal plane and about the hinge 22 in the vertical plane. Tension means, such as springs 30 and 32 are each connected to an edge of the rectangular piece 20 of the arm exercise member and to an edge of the platform 10 spaced from the platform extension 28 to provide tension for operating the arm exerciser member 12 and 14.

The leg and abdomen exercise member 16 is connected to the platform 10 at a point on the long axis of the platform 10 and spaced somewhat from the end of the platform 10 distal from the arm exercise members 12 and 14. The leg exercise member 16 consists of a telescopic tube 34 having internal opposing mounting pins 36 and 38 therein. The top 40 of tube 34 is formed in a T-shape with open ends 42 and 44. Tension means, shown as springs 46 and 48 are mounted on one end on pins 36 and 38 and extend out of the open ends 42 and 44 of tube 34 and terminate at their other ends on foot loop members 50 and 52. Foot loop members 50 and 52 are shaped such that the user's foot can be inserted therein.

Tube 34 is held in position on platform 10 by means of a ball pivot 54 mounted on the platform 10 and having a vertically extending rod 56 connected to the ball pivot 54. A compression spring 58 is positioned around the rod 56. The rod 56 extends into tube 34 and can move up and down therein as the user compresses the spring 58 by pushing down on tube 34. While a particular compression means is described herein it should be understood that other types of compression means may be employed.

I claim:

1. An exercise apparatus comprising elongated platform means for supporting the body of a user in the prone position, hinged arm exercise means each pivotally mounted on said platform means at opposite sides thereof for pivotal movement about a first axis which is substantially parallel and substantially coplanar with a plane passing horizontally through the platform means the longitudinal axis of said platform means, said arm exercise means extending laterally from said platform means, spring tension means connected to oppose pivotal movement of said arm exercise members in at least one direction about said first axis, and a leg and abdominal exercise means mounted on said platform and extending upwardly therefrom in spaced relationship to said arm exercise members to receive the feet of a user during an exercise program, said leg and abdominal exercise means being mounted for universal pivotal movement relative to said platform means.

2. The exercise apparatus of claim 1 wherein each said arm exercise means is mounted for pivotal movement about a second axis which is a vertical axis substantially normal to said first axis thereby rendering each said arm exercise means pivotable in both a horizontal and vertical plane, said spring tension means operating to oppose pivotal movement of each said arm exercise members about the second axis.

3. The exercise apparatus of claim 2 wherein said platform means is formed to provide a soft comfortable mat and wherein said platform means includes horizontal extensions laterally positioned on opposite sides thereof, said arm exercise means having arcuate shaped end portions, the arm exercise means being mounted to said platform means by means of a pivot pin extending through an arcuate shaped portion of each of said arm exercise means and a horizontal extension of said platform means upon which said arcuate shaped portion of each said exercise means lies.

4. The exercise apparatus of claim 3 including a hinge connecting said arcuate shaped portion of each said arm exercise means to the remainder of said means, said hinge forming said first axis, and hand grip means adapted to be gripped by the hands of a user mounted on the end of said arm exercise means distal from said platform means.

5. The exercise apparatus of claim 1 wherein said leg and abdominal exercise means includes first and second elongated sections, one end of said first section being received in telescoping relationship within one end of said second section and being mounted for limited longitudinal movement relative thereto, and spring means for opposing relative movement of said first and second sections in at least one direction.

6. The exercise apparatus of claim 5 wherein the free end of said first section is connected to a ball pivot secured to said platform means.

7. The exercise apparatus of claim 6 wherein the free end of said second section is connected to a cross bar extending substantially normal to said first and second sections, a foot engaging member is positioned at each end of said cross bar, and tension spring means is connected to each said foot engaging member to hold each said foot engaging member against the adjacent end of the cross bar and to oppose movement of each said foot engaging member away from the end of said cross bar.

* * * * *